United States Patent [19]

Bingham et al.

[11] Patent Number: 4,576,287

[45] Date of Patent: Mar. 18, 1986

[54] APPARATUS AND METHOD FOR CHECKING THE CONTENTS OF ENVELOPES AND SORTING DOCUMENTS BY THICKNESS

[75] Inventors: George H. Bingham; Edward A. Krupotich, both of Los Altos; Burton J. Rosensweig, Mountain View, all of Calif.

[73] Assignee: Omation Corporation, Mountain View, Calif.

[21] Appl. No.: 493,638

[22] Filed: May 11, 1983

Related U.S. Application Data

[63] Continuation-in-part of Ser. No. 416,668, Sep. 10, 1982, abandoned.

[51] Int. Cl.[4] ..... B07C 1/16; B07C 5/06

[52] U.S. Cl. ..... 209/601; 200/61.41; 209/604; 209/900; 271/262

[58] Field of Search ..... 209/546, 552, 559, 600, 209/601, 603, 604, 625, 900, 586, 605; 271/262, 265, 263; 200/61.41, 61.42; 33/147 L, 147 N, 143 L, 174 L

[56] References Cited

U.S. PATENT DOCUMENTS

| | | | |
|---|---|---|---|
| 3,417,476 | 12/1968 | Martens | 209/604 |
| 3,593,850 | 7/1971 | Denk et al. | 209/600 |
| 3,712,468 | 1/1973 | Wenner et al. | 209/601 |
| 4,030,607 | 6/1977 | Suda et al. | 209/900 |
| 4,121,716 | 10/1978 | Luperti et al. | 209/604 |
| 4,378,109 | 3/1983 | Takahashi et al. | 209/604 |
| 4,449,399 | 5/1984 | Hain | 209/604 |

*Primary Examiner*—David A. Scherbel
*Assistant Examiner*—Donald T. Hajec
*Attorney, Agent, or Firm*—Flehr, Hohbach, Test, Albritton & Herbert

[57] ABSTRACT

Apparatus and method for checking the contents of envelopes and sorting envelopes and other documents according to thickness. The envelopes or other documents are fed along a predetermined path, the thickness of each envelope or document is checked as it travels along the path, and any envelope or document having a thickness greater than a predetermined thickness is diverted from the path.

6 Claims, 9 Drawing Figures

APPARATUS AND METHOD FOR CHECKING THE CONTENTS OF ENVELOPES AND SORTING DOCUMENTS BY THICKNESS

This is a continuation-in-part of application No. 416,668, filed Sept. 10, 1982, now abandoned.

This invention pertains generally to equipment for handling documents such as envelopes and letters, and more particularly to apparatus and a method for sorting such documents according to their thickness.

It is sometimes desirable to check the contents of envelopes without opening the envelopes and to sort envelopes and other documents according to their thickness. For example, institutions which receive payments by mail do not want to discard a customer's check or payment voucher with a supposedly empty envelope. In other cases, envelopes need to be checked to make certain that they contain the correct contents, e.g. one payroll check or one dividend check. Likewise, it is sometimes desirable to separate incoming mail into different groups according to content, e.g. payments and other materials, before opening the same. Where large numbers of envelopes are processed, it is not practical to check each one manually.

Heretofore, some machines have been provided for checking envelopes for contents by the relative opaqueness or transparency of the envelopes. While these machines are generally faster than manual checking, they are subject to certain limitations and disadvantages in that many envelopes are so opaque that it is impossible to determine whether they contain anything by the opaqueness technique.

It is in general an object of the invention to provide a new and improved apparatus and method for checking the contents of envelopes and sorting envelopes and other documents by thickness.

Another object of the invention is to provide an apparatus and method of the above character which are reliable and capable of processing large numbers of envelopes in a relatively short time.

Another object of the invention is to provide an apparatus and method of the above character which overcome the limitations and disadvantages of machines which rely upon the transparency of envelopes to check their contents.

These and other objects are achieved in accordance with the invention by feeding the envelopes or other documents along a predetermined path, sensing the thickness of each envelope or document as it travels along the path, and diverting from the path any envelope or document which has a thickness greater than a predetermined thickness.

Figure 1:
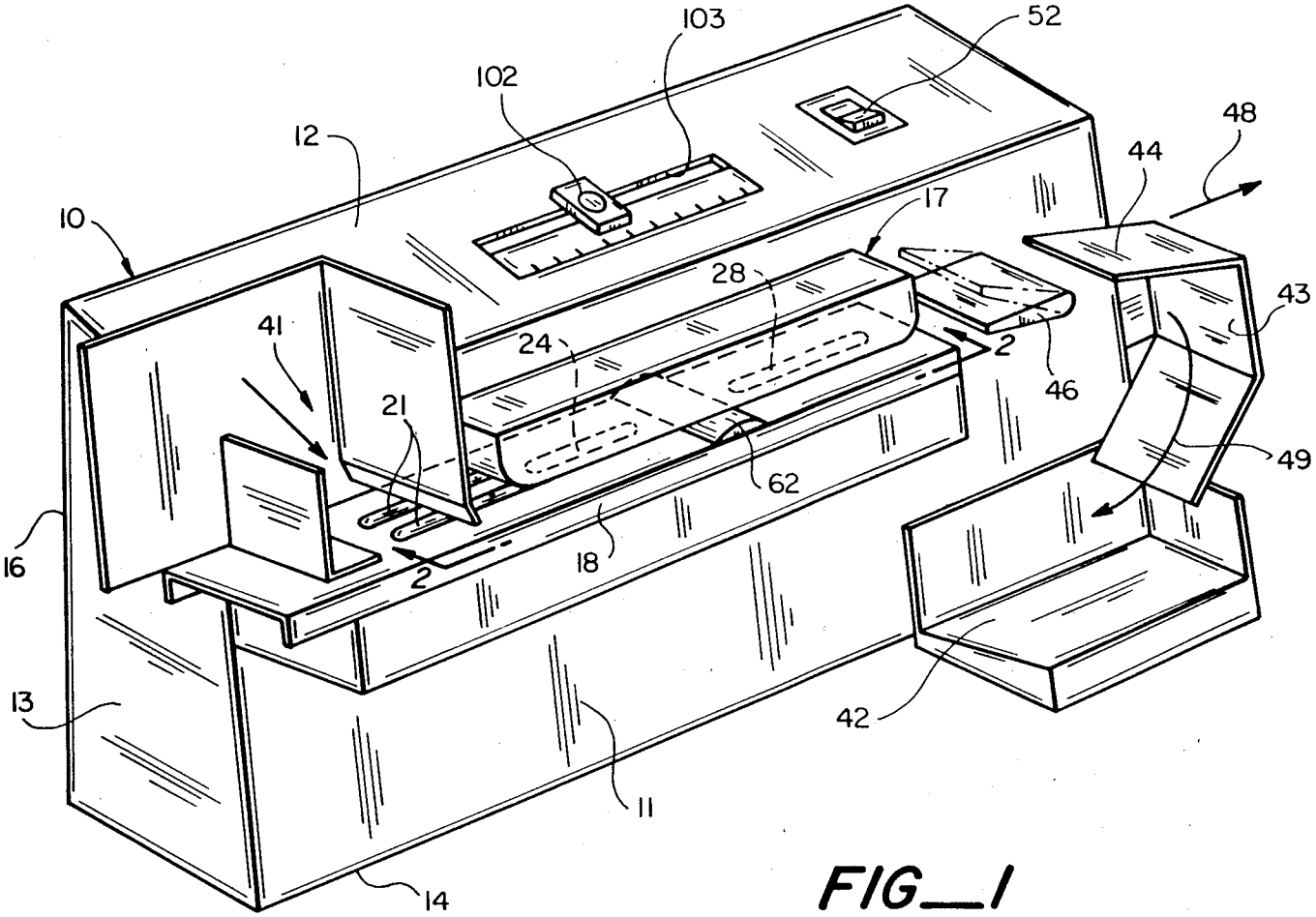
FIG. 1 is an isometric view of one embodiment of apparatus according to the invention for checking the contents of envelopes.
Figure 2:
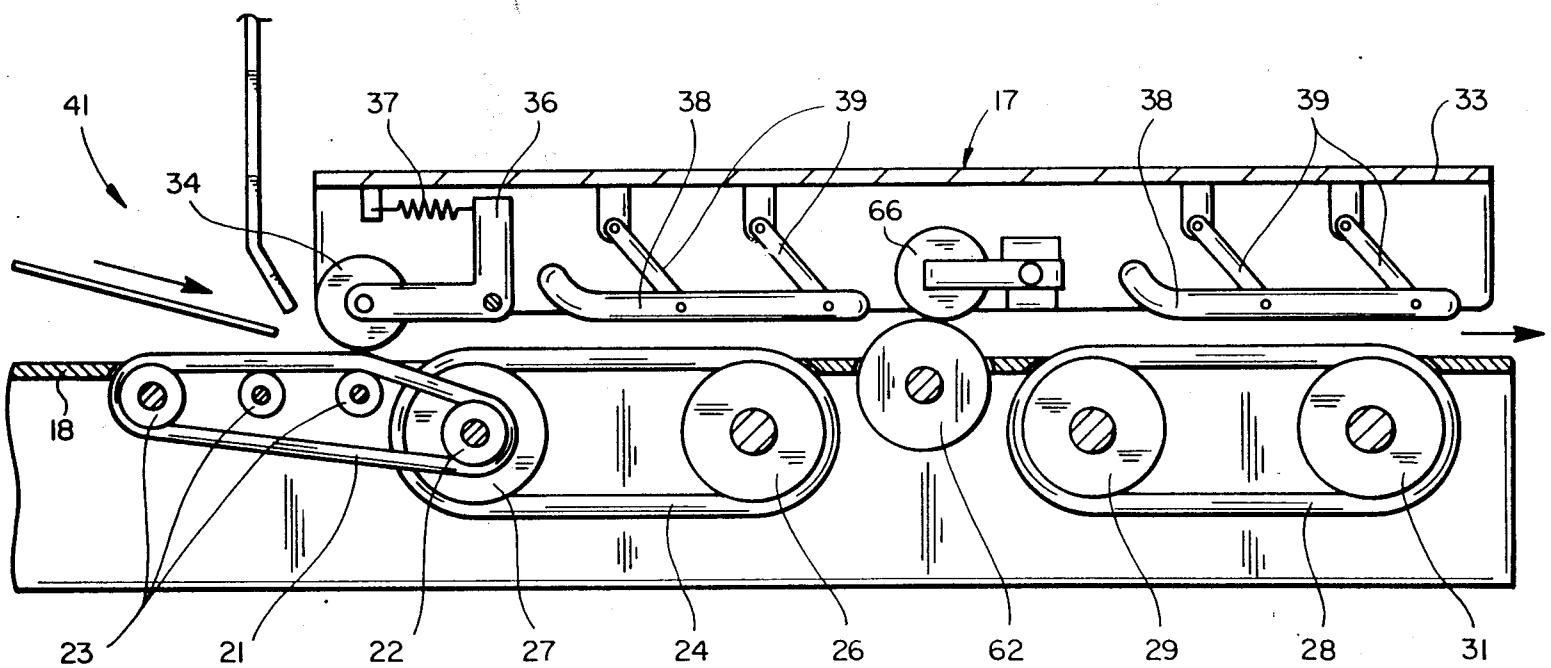
FIG. 2 is a fragmentary sectional view taken along line 2—2 in FIG. 1.

In the drawings, the invention is illustrated in connection with a machine for checking the contents of envelopes and diverting envelopes which exceed a predetermined thickness. This apparatus includes a cabinet 10 having a front wall 11, a top wall 12, end walls 13, a bottom wall 14, and a removable rear cover 16.

Conveyor means 17 is mounted on the outside of the front wall of the cabinet for feeding envelopes along a predetermined path where the thickness of the envelopes is checked. This means comprises a horizontally extending table 18 having a series of conveyor belts projecting through openings therein and means for holding envelopes down against the belts as they pass through the conveyor. The belts include a pair of feeder belts 21 trained about drive pulleys 22 and idler pulleys 23, a first transport belt 24 trained about a drive pulley 26 and an idler pulley 27, and a second transport belt 28 trained about a drive pulley 29 and an idler pulley 31. Transport belt 24 is inclined relative to the front wall of the cabinet so that envelopes are held against the front wall as a guiding surface as they are carried by this belt.

A housing 33 is positioned above table 18 and carries the means which holds the envelopes against the conveyor belts. This means includes stationary separator stones or wheels 34 mounted on pivot arms 36 and urged downwardly toward feeder belts 21 by springs 37, and a pair of elongated guides 38 mounted on parallel pivot links 39 above transport belts 24, 28. A hopper 41 is provided for feeding envelopes to the input end of the conveyor, and separator stones 34 serve to feed the envelopes individually from the bottom of a stack in the hopper to feeder belts 21.

At the output of the conveyor, means is provided for diverting the envelopes from the normal path of travel to a tray 42. This means comprises a guide 43 having a flange 44 aligned generally with the surface of conveyor table 18 and a flipper 46 positioned between the conveyor and flange 44. The flipper is movable between a normal position shown in solid lines and a raised position shown in phantom lines in FIG. 1. With the flipper in its normal position, envelopes pass along the normal path across the surfaces of the flipper and flange 44 as indicated by arrow 48. When the flipper is in its raised position, the envelopes strike the lower surface of the flipper and are diverted from the normal path to tray 42 as indicated by arrow 49.

The conveyor is driven by an electrically energized motor 51 mounted within the cabinet on bottom wall 14. Energization of the motor and the other electrical portions of the apparatus is controlled by a power switch 52 mounted on the top wall 12 of the cabinet. Power is transferred from the motor to the conveyor by a belt 53 which is trained about a pulley 54 on the motor shaft and one section of a pulley 56 which is mounted on the shaft of the drive pulleys 22 for feeder belts 21. Pulleys 54 and 56 are oriented in perpendicular planes, and an idler pulley 57 guides drive belt 53 between these planes. Power is transferred from pulley 56 to the drive pulleys 26, 29 for transport belts 24, 28 by pulleys 58, 59 and transfer belts 60, 61. Pulleys 58, 59 are mounted on the shafts of pulleys 26, 29, respectively, belt 60 is trained about a second section of pulley 56 and one section of pulley 58, and belt 61 is trained about a second section of pulley 58 and about pulley 59. In one presently preferred embodiment, the ratios of the pulleys are selected such that transport belts 24, 28 travel somewhat faster than feeder belts 21 to maintain good separation between the envelopes as they pass through the conveyor.

Means is provided for gauging the thickness of the envelopes as they travel along the path of conveyor 17. This means comprises a gauging roller 62 which projects through an opening in table 18 and is driven from pulley 59 by a belt 63 and a drive pulley 64. A gauging wheel 66 is positioned above the gauging roller and is deflected by envelopes passing over the gauging roller, the amount of deflection corresponding to the thickness of the envelopes.

Gauging wheel 66 is carried by a shaft 67 which is rotatively mounted in a bracket 68 affixed to the back side of front panel 11. Wheel 66 is rotatively mounted on an axle 69 carried by an arm 71 which is rotatively mounted on shaft 67 toward the outer end thereof. A second arm 72 is affixed to the outer end of shaft 67, and a tension spring 73 is connected between arms 71 and 72 whereby wheel 66 is urged in a downward direction toward roller 62. The rest position of wheel 66 is determined by an adjustable stop screw 74 which is carried by arm 71 and bears against arm 72. A compression spring 76 is mounted over shaft 67 to urge arm 71 outwardly against arm 72.

The manner in which gauging wheel 66 is mounted provides protection against damage from excessive deflection due to overly thick objects passing between the wheel and the gauging roller. In this regard, spring 73 is selected to provide a force sufficient to hold arms 71, 72 together for movement as a unit with envelopes of normal thickness. With thicker objects, however, the force of spring 73 is overcome, and arm 71 is free to pivot without turning shaft 67.

An elongated flag arm 78 is affixed to the inner end of shaft 67 for pivotal movement about the axis of the shaft. This arm is substantially longer (e.g. 10 times) than arm 71, and a deflection of gauging wheel 66 produces a substantially greater deflection at the free end of arm 78. The rest position of arm 78 is determined by an adjustable stop screw 79, and the arm is yieldably held against this stop by a spring 81. A damper 82 damps movement of the arm away from stop 79.

Means is provided for sensing the position of arm 78 and providing an output signal when the thickness of an envelope passing beneath gauging wheel 66 exceeds a predetermined thickness. This means includes a pivotally mounted feeler 84 adjacent to the free end of arm 78 and a spring 85 which urges the feeler toward the free end of the arm. A normally energized solenoid 86 holds the feeler in a rest position out of contact with the arm, and energization of this solenoid is controlled by an electro-optical sensor 87. This sensor produces a signal which causes the solenoid to be deenergized when arm 78 is deflected from its rest position by an amount corresponding to the thickness of an empty envelope. Feeler 84 is formed with a surface 88 which bears against the free end of arm 78 when the solenoid is deenergized and the arm is in the position corresponding to the thickness of an empty envelope. Feeler 84 also includes a notch 89 in which the free end of arm 78 is received when the gauging wheel is deflected by an object thicker than an empty envelope. The position of feeler 84 is monitored by a second electro-optical sensor 91 which provides an output signal when surface 88 clears the free end of arm 78 and the feeler pivots into its tripped position with the free end of the arm received in notch 89.

Figure 3:
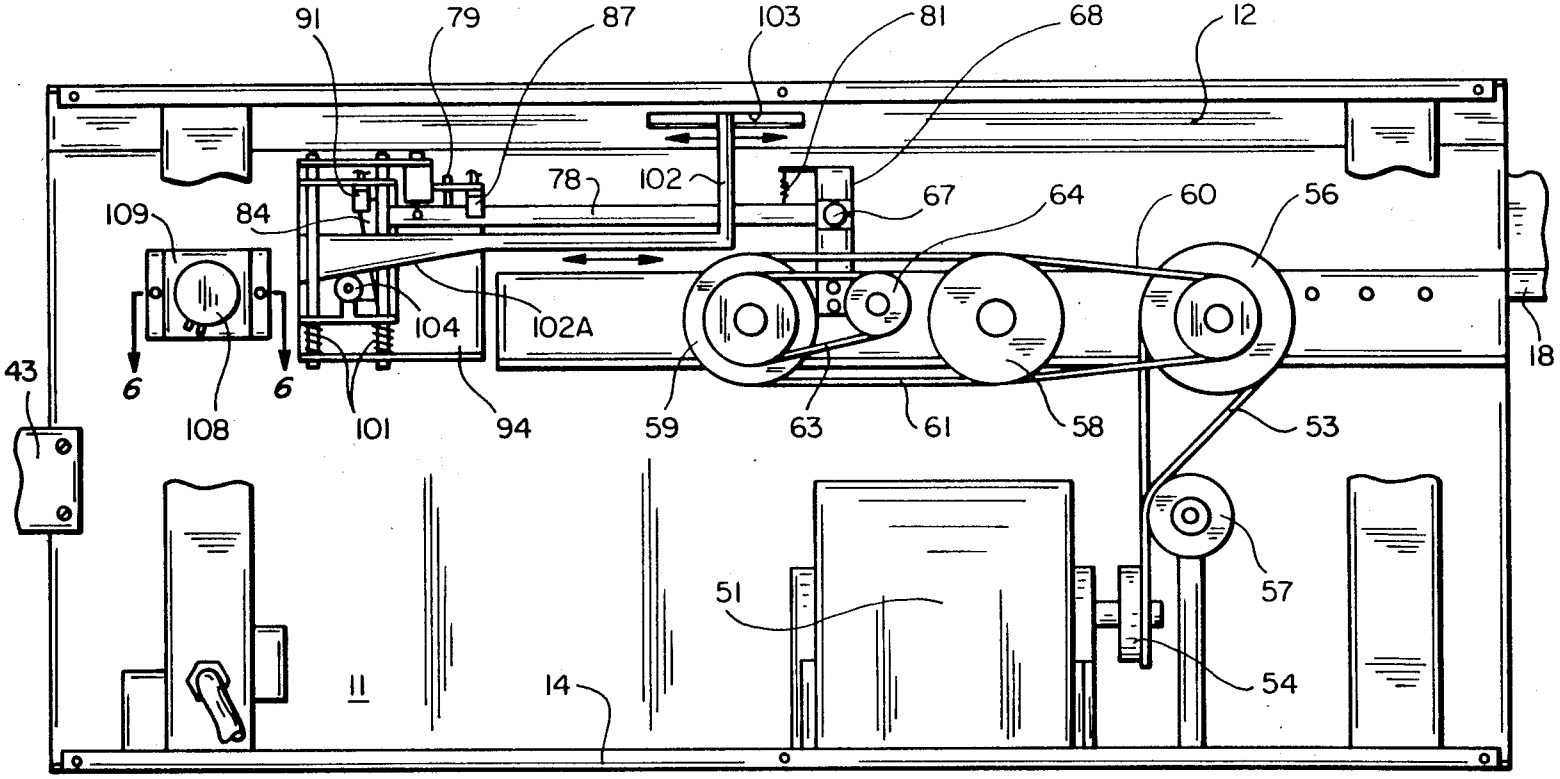
FIG. 3 is a rear elevational view of the embodiment of FIG. 1, with the rear cover removed.
Figure 4:
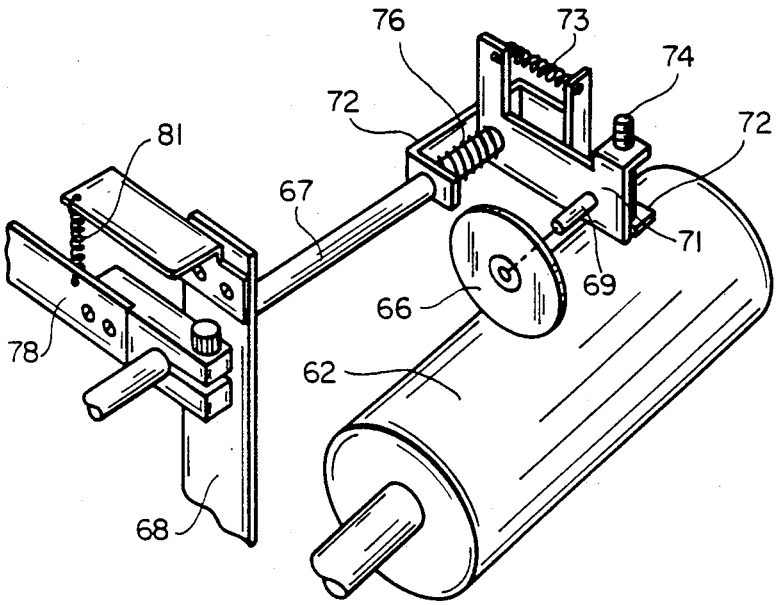
FIG. 4 is an isometric view of the thickness gauging section of the embodiment of FIG. 1.

The sensing assembly includes a stationary frame 94 which is mounted in a fixed position on the back side of front panel 11 and a movable frame 96 on which the feeler mechanism is mounted. The stationary frame comprises a generally U-shaped member having upper and lower flanges 97, 98 between which posts 99 extend. The movable frame is slideably mounted on the posts and urged in an upward direction by springs 101. The thickness of envelopes which produces tripping of the feeler mechanism is determined by the vertical position of frame 96, and this can be adjusted by a control arm 102 which extends through a slotted opening 103 in the upper wall of the cabinet. The inner end of arm 102 has an inclined surface **102*a* which engages a roller 104 affixed to movable frame 96. Thus, movement of arm 102 to the left, as viewed in FIG. 3**, permits the feeler mechanism to rise so that it will trip in response to thinner envelopes, whereas moving the arm to the right moves the feeler mechanism in a downward direction to increase the thickness adjustment.

Figure 6:
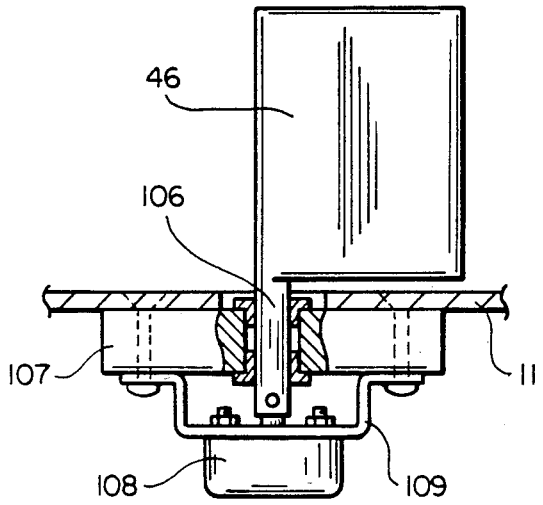
FIG. 6 is a fragmentary sectional view taken along line 6—6 in FIG. 3.

As illustrated in FIG. 6, flipper 46 is mounted on a shaft 106 which is rotatively mounted in a bearing block 107 on the back side of front panel 11. The flipper is actuated by a rotary solenoid 108 mounted on a bracket 109 and connected to the inner end of shaft 106.

Figure 7:
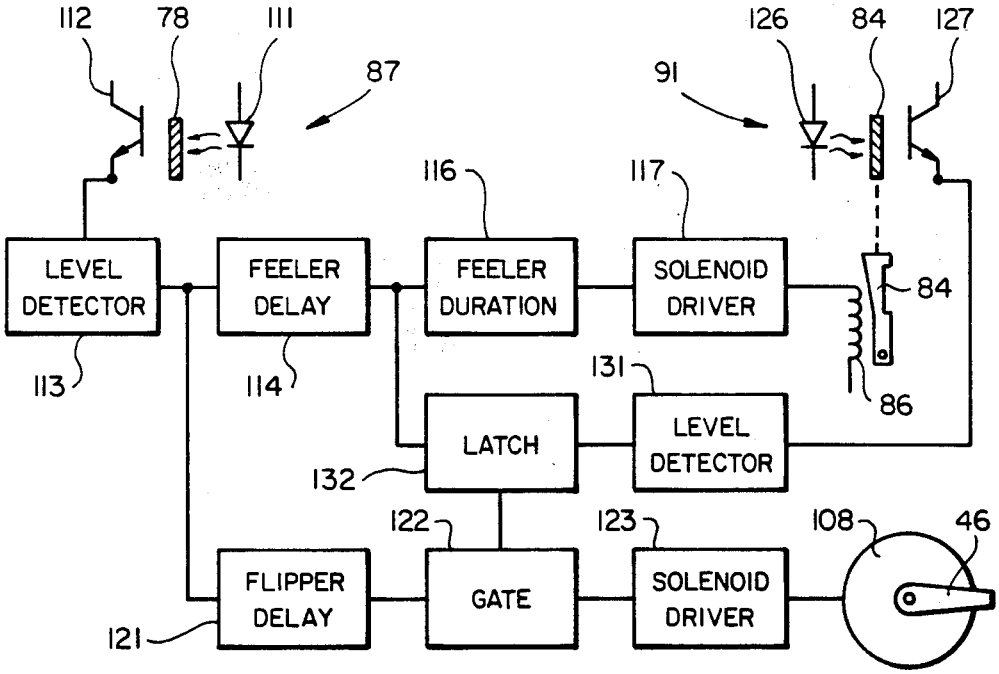
FIG. 7 is a functional block diagram of the sensing and diverting circuits of the embodiment of FIG. 1.

The manner in which feeler solenoid 86 and flipper solenoid 108 are controlled by the signals produced by sensors 87, 91 is illustrated in FIG. 7. Sensor 87 comprises a light source 111 and a photo-sensor 112, with arm 78 interposed between these elements. When the arm is deflected as the leading edge of an envelope passes beneath gauging wheel 66, light from the source impinges upon the sensor, producing a signal which is applied to a level detector 113, which comprises a Schmitt trigger. Upon receipt of this signal, the level detector produces an output pulse which is applied to the input of a delay circuit 114. The output of this circuit is connected to a pulse-width control circuit 116, and the output of this circuit is connected to the input of a solenoid driver 117. The output of the solenoid driver is connected to feeler solenoid 86. Delay circuit 114 determines when the solenoid is deenergized, and circuit 116 determines how long it remains deenergized.

The output of level detector 113 is also connected to the input of a second delay circuit 121, and the output of this circuit is connected to one input of a gate 122. The output of the gate is connected to the input of a second solenoid driver 123, and the output of this driver is connected to flipper solenoid 108.

Sensor 91 comprises a light source 126 and a photo-sensor 127 between which feeler 84 is interposed. When the feeler is in its tripped position, light from source 126 passes to sensor 127, producing a signal which is applied to the input of a level detector 131. The output of this level detector is connected to a latch 132, and the output of delay circuit 114 is connected to a second input of the latch. The output of the latch is connected to a second input of gate 122.

Operation and use of the apparatus, and therein the method of the invention, can now be described. A stack of envelopes to be checked for contents is placed in hopper 41, and control arm 102 is adjusted to position the feeler mechanism to detect an envelope having a thickness greater than the desired thickness. In this example, it is assumed that envelopes which are not empty are to be detected, and the feeler mechanism is set to the thickness of an empty envelope. As the envelopes travel through the conveyor, gauging wheel 66 and arm 78 are deflected by an amount corresponding to the thickness of the envelope. When arm 78 is deflected from its rest position, feeler solenoid 86 is deenergized, and spring 85 positions feeler 84 to monitor the position of arm 78 to determine whether the envelope passing beneath the gauging wheel is greater in empty, feeler 84 returns to its rest position without tripping, flipper solenoid 108 remains deenergized, and the envelope exits from the conveyor along the normal path indicated by arrow 48.

In the event that an envelope thicker than the amount set by control arm 102 passes beneath gauging wheel 66, arm 78 is deflected to the pcint where feeler 84 trips, producing an output signal from sensor 91. In response to this signal, level detector 131 produces a pulse which sets latch 132 to enable gate 122 to pass the delayed pulse from circuit 121. Solenoid 108 is energized in response to this pulse to actuate flipper 46 to divert the thick envelope to tray 42. The amount of delay provided by circuit 121 is adjusted to permit the thick envelope to travel from gauging wheel 66 to flipper 46 before the flipper solenoid is energized so that envelopes which precede the thick envelope will not be diverted. Latch 132 is reset by the next pulse from delay circuit 114, and solenoid 108 is deenergized again so that only the thick envelope is diverted.

Figure 5:
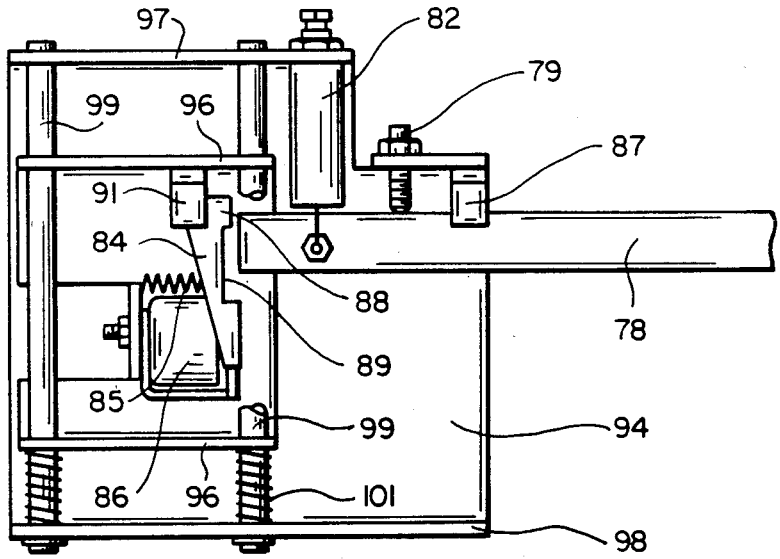
FIG. 5 is a rear elevational view of the sensing section of the embodiment of FIG. 1.
Figure 8:
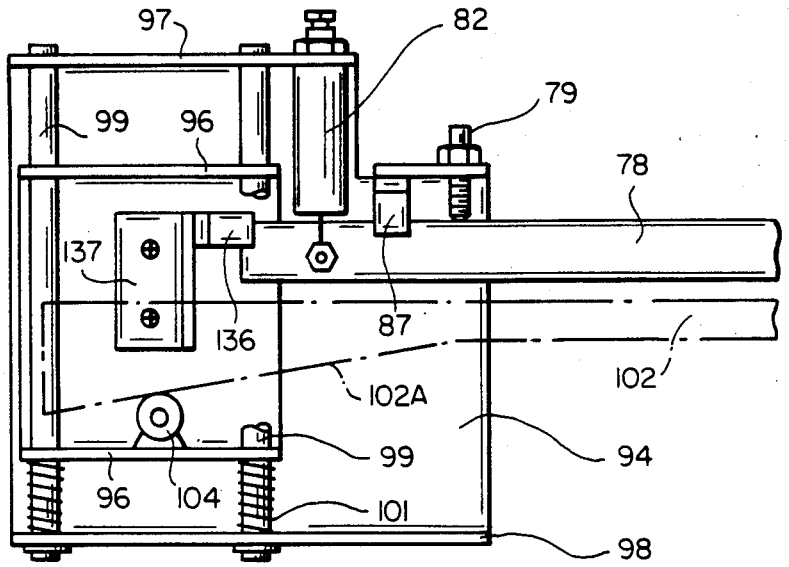
FIG. 8 is a rear elevational view, similar to FIG. 5, of a second embodiment of a sensing section for use in the embodiment of FIG. 1.

The sensing assembly illustrated in FIG. 8 is similar to the sensing assembly of FIG. 5 in that it includes a stationary frame 94 and a movable frame 96 which is slideably mounted on posts or guide rods 99 which extend between horizontal flanges 97, 98 on the stationary frame. The movable frame is urged in an upward direction by compression springs 101, and the vertical position of the movable frame is adjusted by a control arm 102 which engages a roller 104 carried by the frame. An electrooptical sensor 136 monitors the position of the free end of flag arm 78 and provides an output signal when the arm is deflected more than an amount corresponding to the thickness of an empty envelope. This sensor is mounted on an L-shaped bracket 137 which is mounted on movable frame 96, and the thickness of envelopes which produces an output signal from the sensor is adjusted by means of control arm 102.

Figure 9:
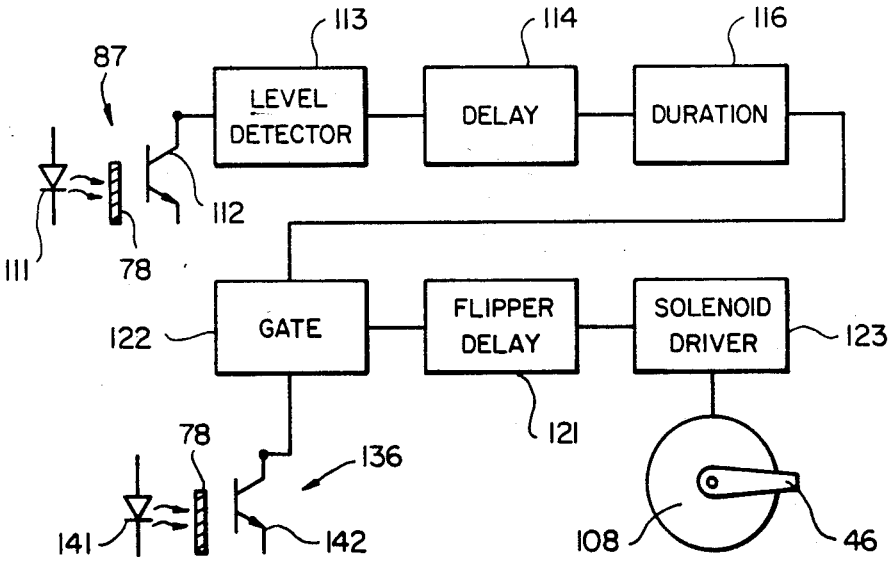
FIG. 9 is a functional block diagram, similar to FIG. 7, of the sensing and diverting circuits in the embodiment of FIG. 8.

As in the embodiment of FIG. 7, sensor 87 detects the presence of the leading edge of an envelope at the gauging wheel 66, and the signal from this sensor is processed to determine a portion of an envelope where the thickness is gauged. As illustrated in FIG. 9, the output of sensor 87 is connected to level detector 113 which produces a pulse when the leading edge of an envelope is detected. This pulse is delayed and stretched by delay circuit 114 and duration timer 116. These circuits can be set so that the thickness of the envelope is monitored in an area where there are no seams, stamps, windows or other variations in the thickness of the envelope itself.

Thickness sensor 136 is similar to sensor 91 of FIG. 7, except it monitors the position of the free end of flag arm 78 directly, rather than monitoring the position of a feeler which is tripped by the arm. This sensor comprises a light source 141 and a light sensor 142, with the free end of the arm being interposed between them. The sensor produces an output signal when the free end is deflected by an amount greater than a distance corresponding to the thickness of an empty envelope.

The gauging period signal from duration timer 116 and the signal from thickness sensor 136 are applied to the inputs of coincidence gate 122, and this gate delivers an output signal only when both the gauging period signal and the thickness detector signal are present. The output signal from gate 122 is delayed by flipper delay circuit 121 while the envelope passes from the gauging station to the flipper, and the signal from delay circuit 121 is applied to solenoid driver 123. The driver is connected to flipper solenoid 108, as in the embodiment of FIG. 7.

Operation and use of the embodiment of FIGS. 8–9 is similar to that described above. However, in this embodiment the gauging period signal from leading edge detector 87, delay circuit 114 and duration timer 116 is gated directly with the signal from thick envelope detector 136. When a thickness greater than an empty envelope is detected during the gauging period, gate 122 delivers an output signal. When the thick envelope reaches the flipper, the flipper is actuated to divert the envelope to tray 42.

The invention has a number of important features and advantages. It provides a fast and reliable means for checking the thickness of envelopes and other documents and sorting the documents accordingly. It is not dependent upon the opaqueness or transparency of the envelopes. In addition, it is readily adjustable to accommodate envelopes or documents of different thicknesses. Although the invention has been described with specific reference to a machine for checking the contents of envelopes, it can be utilized in a variety of other applications for sorting documents according to thickness.

It is apparent from the foregoing that a new and improved apparatus and method for determining if envelopes are empty have been provided. While only certain presently preferred embodiments have been described in detail, as will be apparent to those familiar with the art, certain changes and modifications can be made without departing from the scope of the invention as defined by the following claims.

We claim:

1. In apparatus for determining whether an object is thicker than a predetermined thickness: means for feeding the object along a path, a gauging element positioned for deflection by the object as it travels along the path, the amount of deflection corresponding to the thickness of the object, a pivot arm, means connecting the gauging element to the arm so that the arm is displaced from a rest position by an amount corresponding to the thickness of the object, a feeler positioned out of engagement with the arm when the arm is in its rest position, means for urging the feeler into engagement with one end of the arm when the arm is displaced from its rest position by an amount corresponding to at least the predetermined thickness, the feeler being in a first position when the arm is in a position corresponding to the predetermined thickness and a second position when the arm is in a position corresponding to a greater thickness, and means for providing an output signal when the feeler is in the second position.

2. The apparatus of claim 1 including a first sensor for providing a signal when a pivot arm is displaced by an amount corresponding to the predetermined thickness, means responsive to the sensor signal for urging the feeler toward the end of the arm, and a second sensor responsive to the position of the feeler for providing the output signal.

3. The apparatus of claim 2 wherein the first and second sensors are electro-optical devices.

4. In apparatus for determining whether an object is thicker than a predetermined thickness: means for feeding the object along a path, a gauging element positioned for deflection by the object as it travels along the path, the amount of deflection corresponding to the thickness of the object, a pivot arm, means connecting the gauging element to the arm so that the arm is displaced from a rest position by an amount corresponding to the thickness of the object, a feeler which bears against one end of the arm for movement between a first position when the arm is in a position corresponding to the predetermined thickness and a second position when the arm is in a position corresponding to a greater thickness, said feeler having a surface which bears against the end of the arm when the position of the arm corresponds to the predetermined thickness and clears the end of the arm when the position of the arm corresponds to the greater thickness, and means for providing an output signal when the feeler is in the second position.

5. In apparatus for determining whether an object is thicker than a predetermined thickness: means for feeding the object along a path, a gauging element positioned for deflection by the object as it travels along the path, the amount of deflection corresponding to the thickness of the object, a pivot arm, means connecting the gauging element to the arm so that the arm is displaced from a rest position by an amount corresponding to the thickness of the object, a first sensor for providing a first signal when the arm is displaced by an amount corresponding to the predetermined thickness, a feeler, means responsive to the first signal for urging the feeler toward the arm, means responsive to the position of the feeler for providing a second signal when the arm is displaced by an amount corresponding to a thickness greater than the predetermined thickness, and means responsive to the second signal for diverting the object from the path.

6. The apparatus of claim 5 wherein the first sensor and the means for providing the second signal comprise electro-optical sensors.

* * * * *